US006336027B1

(12) United States Patent
Sakai et al.

(10) Patent No.: US 6,336,027 B1
(45) Date of Patent: Jan. 1, 2002

(54) INDUCTION HEATING FUSING DEVICE

(75) Inventors: Katsuhide Sakai; Takahiro Tsujimoto, both of Toyokawa (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/670,519

(22) Filed: Sep. 26, 2000

(30) Foreign Application Priority Data

Sep. 29, 1999 (JP) ..... 11-276407

(51) Int. Cl.[7] ..... G03G 15/20
(52) U.S. Cl. ..... 399/328; 219/216; 399/330
(58) Field of Search ..... 399/328, 330, 399/333, 334, 335, 336; 219/216, 600, 619, 674

(56) References Cited

U.S. PATENT DOCUMENTS 6,069,347 A * 5/2000 Genji et al. ..... 219/619

FOREIGN PATENT DOCUMENTS

| | | |
|---|---|---|
| JP | 59-33788 | 2/1984 |
| JP | 7-287471 | 10/1995 |
| JP | 8-179647 | * 7/1996 |
| JP | 9-305043 | 11/1997 |
| JP | 9-306653 | 11/1997 |
| JP | 11-15304 | 1/1999 |

* cited by examiner

*Primary Examiner*—Robert Beatty
*Assistant Examiner*—Hoan Tran
(74) *Attorney, Agent, or Firm*—McDermott, Will & Emery

(57) ABSTRACT

An induction heating fusing device has a core that forms a magnetic circuit, an inductive coil wrapped around the core and a roller as a conductive member. A diameter of a wire for the inductive coil varies from the center to the ends of the length of the roller. Consequently, the number of turns in the coil varies from the center to the ends of the length of the roller, ensuring a uniform temperature distribution throughout the length of the roller.

12 Claims, 4 Drawing Sheets

INDUCTION HEATING FUSING DEVICE

This application is based on application No. 11-276407 filed in Japan, the contents of which is hereby incorporated by reference.

BACKGROUND OF THE INVENTION

1. Field of the Invention

The present invention pertains to a fusing device used in an electrophotographic image forming apparatus such as a copying machine, printer or facsimile machine.

2. Description of the Related Art

An electrophotographic image forming apparatus such as a copying machine, printer or facsimile machine has a fusing device that fuses onto a sheet a toner image carried on the sheet.

While various methods may be used by the fusing device, in response to the recent demand for energy conservation, fusing devices using the induction heating method, which offers a better conversion efficiency than a fusing device using a halogen lamp as the heat source, have been proposed in Japanese Laid-Open Patent Application Hei 7-287471, for example.

A fusing device using the induction heating method comprises a hollow conductive member that is fixed or movable, a closed magnetic circuit iron core that forms a closed magnetic circuit and part of which runs through the empty space of the conductive member, and an inductive coil that is wrapped in a spiral fashion around the closed magnetic circuit iron core. A magnetic flux generates induction heat in the conductive member by supplying electric current to the inductive coil, so that the conductive member is heated based on induction heating.

The conductive member has a roller configuration. A sheet carrying a non-fused toner image is conveyed by this roller-configured conductive member and another roller that is in contact with the conductive member while the sheet is grasped in between them, and fusing is performed based on the heat caused by induction heating and the pressure exerted by the rollers.

Incidentally, one of the features of the induction heating method is that the temperature rises rapidly. In other words, as an electric current is supplied to the coil, a temperature appropriate for fusing is reached in a very short period of time, such as one or two seconds. In order to take advantage of this strength, a material having a small heat capacity is usually used for the conductive member that is heated based on induction heating. Conversely, it may be said this fusing device easily cools down to such an extent that its heat capacity is small.

In particular, the end areas of the roller easily cool down in comparison with the center area of the roller. Therefore, in a conventional fusing device using the induction heating method, the temperature is increased over the entire roller so that the temperature of the end areas does not decrease below the level appropriate for fusing. Consequently, the temperature of the end areas is lower than the temperature of the center area. The problem therefore occurs that the temperature along the length of the roller, i.e., the temperature along the width of the sheet, is not uniform. In addition, because the temperature in the center area is higher than the level appropriate for fusing, an excessive amount of energy is consumed accordingly, which is not desirable.

OBJECTS AND SUMMARY

In view of the situation described above, the object of the present invention is to provide an improved induction heating fusing device.

Another object of the present invention is to provide an induction heating fusing device that can fuse a toner image using a uniform fusing temperature throughout the width of the sheet.

In order to attain these and other objects, according to one aspect of the present invention, the induction heating fusing device comprises a core that forms a magnetic circuit, an inductive coil located around the core, and a continuous conductive member into which part of the core extends, wherein the diameter of the inductive coil varies from the center of the length of the core to the ends of the core.

Furthermore, the diameter of the inductive coil is larger at the center of the length of the core than at one end of the core.

Furthermore, the inductive coil is alternately connected at one end of the core.

Furthermore, the diameter of the coil at the other end is the same as at the center of the core.

BRIEF DESCRIPTION OF THE DRAWING

These are other objects and features of the present invention will become apparent from the following description of preferred embodiments thereof taken in conjunction with accompanying drawings, in which.

In the following description, like parts are designated by like reference numbers throughout the several drawings.

DETAILED DESCRIPTION OF THE PREFERRED EMBODIMENTS

[Embodiment 1]

Figure 1:
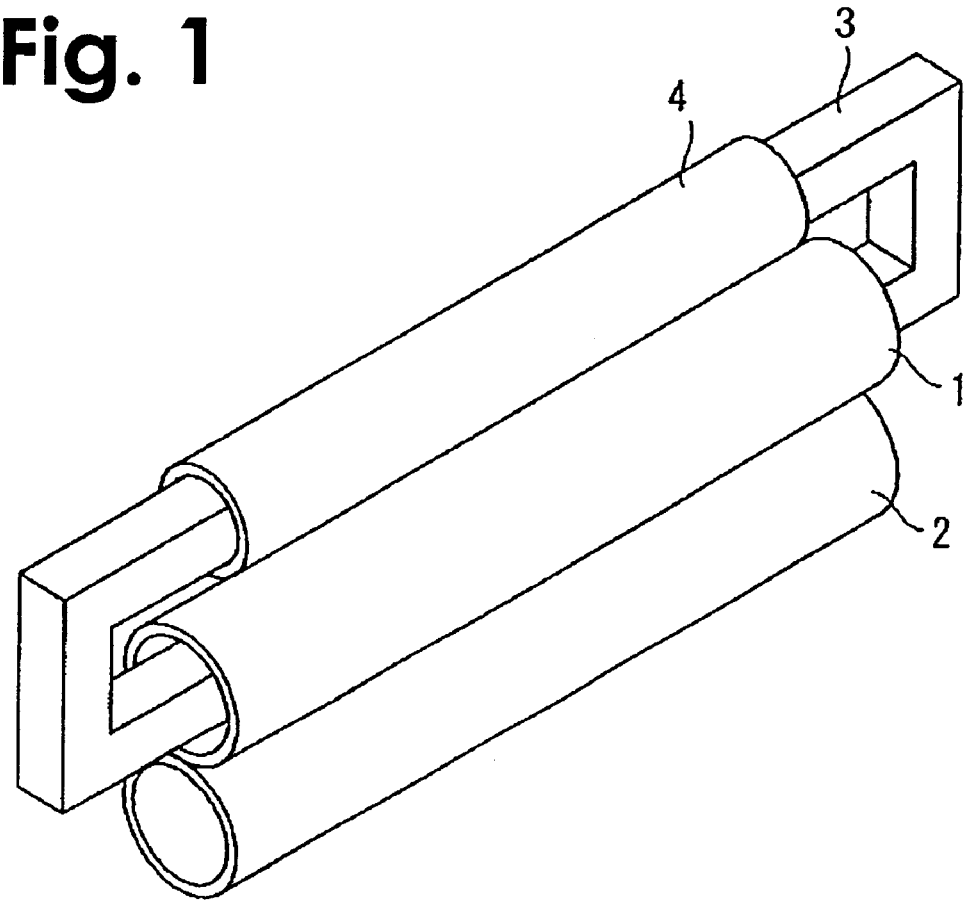
FIG. 1 is a perspective view showing the construction of a fusing device comprising an embodiment 1.

FIG. 1 shows the basic construction of the induction heating fusing device pertaining to the present invention.

This fusing device is used in an image forming apparatus that conveys sheets using the center of the sheet as the reference for conveyance.

This fusing device comprises a fusing roller 1 that is heated based on induction heating, a backup roller 2 that is in contact with the fusing roller 1, a core 3 that forms a magnetic circuit, and an inductive coil 4 that is wrapped around the core 3.

In a fusing operation, when the fusing roller 1 has reached a prescribed temperature appropriate for fusing, a sheet is conveyed so that it becomes held between the fusing roller 1 and the backup roller 2, and the non-fused toner image on the sheet is fused and bonded onto the sheet.

The fusing roller 1 comprises a cylindrical conductive member and a separating layer on the outer surface of the conductive member so that the toner does not stick to the outer surface of the roller. The conductive member is preferably made of stainless steel or aluminum, and the separating layer is made of silicone rubber, for example.

The backup roller 2 is pushed toward the fusing roller 1 by means of a spring not shown in the drawings. An appropriate amount of force is applied to the sheet conveyed by this backup roller 2.

The core 3 forms a closed magnetic circuit based on the magnetic field caused by the inductive coil 4. The core 3 is made of layered silicone steel in the same manner as a transformer.

Figure 2:
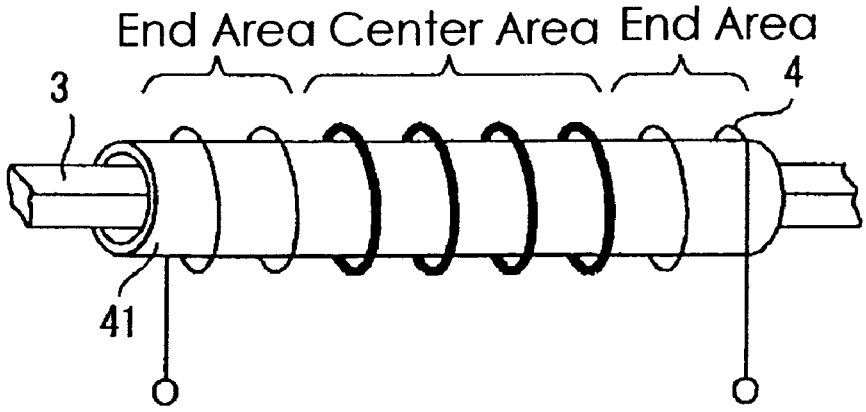
FIG. 2 is a perspective view showing an inductive coil pertaining to the embodiment 1.

The inductive coil 4 comprises enamel-coated lead wire, which is used for regular coils, wrapped around a bobbin 41 located around the core 3, as shown in FIG. 2. This inductive coil 4 comprises a lead wire that has a larger diameter at the center of the length of the fusing roller 1 (the direction perpendicular to the sheet conveyance) than at the end areas of the fusing roller.

Consequently, when the lead wire is wrapped around the core 3 without the existence of unnecessary gaps between the individual rings, the number of turns of the lead wire is larger in the end areas than in the center area. Therefore, when power is supplied to the inductive coil 4 wrapped around the core 3 in this way, the amount of heat generated in the end area is larger than in the center area (this concept is explained in detail below).

Figure 3A:
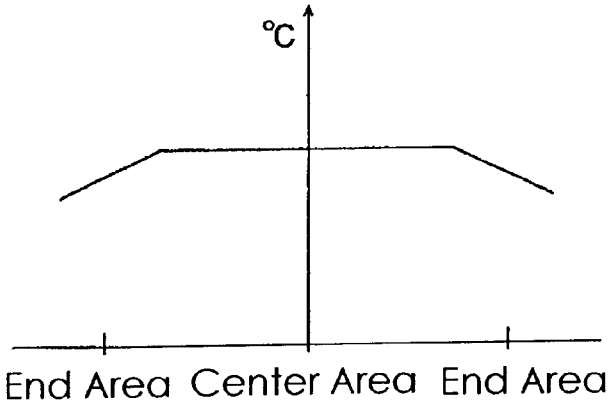
FIG. 3A is a drawing showing the temperature distribution in a conventional induction heating fusing device along the width of the sheet.
Figure 3B:
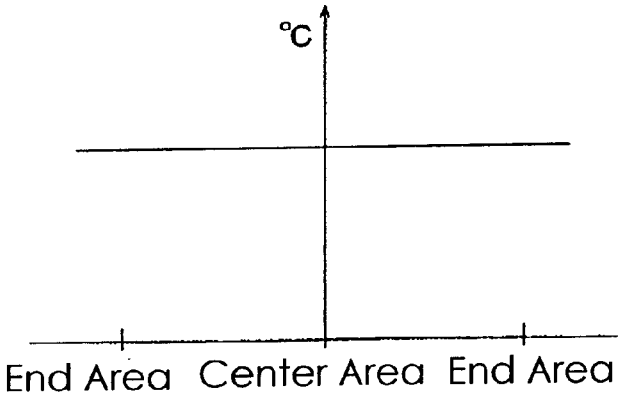
FIG. 3B is a drawing showing the temperature distribution in the embodiment 1 along the width of the sheet.

FIGS. 3A and 3B show the temperature distributions along the length of the roller in a conventional induction heating fusing device and in the induction heating fusing device of this embodiment, respectively.

As shown in the drawings, in the conventional device shown in FIG. 3A, the temperature is lower in both end areas. This is due to the fact that because the amount of heat generated per unit area is the same from the center to the end, the temperature drops in the end areas where the heat more easily escapes. In contrast, in the device of this embodiment shown in FIG. 3B, the temperature stays constant from the ends to the center, indicating a uniform level of temperature throughout the length of the roller.

The reason that the temperature remains constant throughout the length of the roller will be explained with reference to the electrical circuit diagram of the fusing device shown in FIG. 4.

Figure 4:
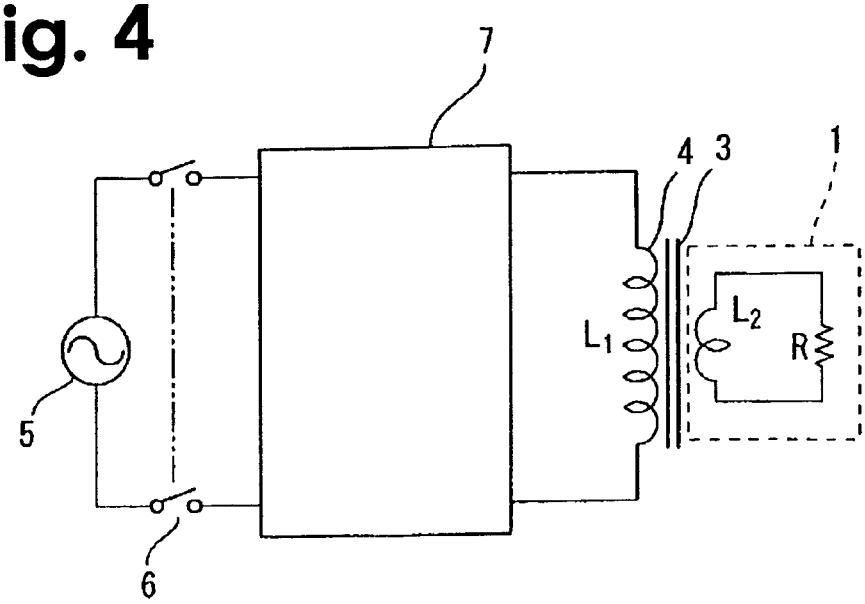
FIG. 4 is an electrical circuit diagram of the fusing device comprising the embodiment 1.

In FIG. 4, the fusing roller 1, the core 3 and the inductive coil 4 of the fusing device shown in FIG. 1 are equivalent to a transformer. In this transformer, the inductive coil 4 is equivalent to a primary coil L1 while the fusing roller 1 is equivalent to a secondary coil L2. The resistance of the fusing roller 1 is shown as R.

In FIG. 4, the power supply 5 supplies a necessary amount of power to the fusing device. The power supply switch 6 serves to control the connection of the power supply 5. The converter 7 converts the power having the commercial frequency received from the power supply 5 into DC current, converts the DC current into AC current having a frequency higher than the commercial frequency, and supplies it to the primary coil L1 of the transformer comprising the primary coil L1, secondary coil L2 and core 3. The frequency of the current supplied is set between several kHz and several hundred kHz in order to keep the device compact in size. Since the area of the cross-section of the core 3 is inversely proportional to the frequency used, the higher the frequency, the smaller diameter core that may be used, which allows conservation of materials. At the same time, since the fusing roller 1, which comprises the secondary coil, may also be made smaller, the heat capacity may be lowered, which is effective in speeding up the temperature increase in the fusing roller.

To explain the heating principle of the induction heat fusing device, when an AC voltage V1 is impressed to the primary coil L1 (having number of turns N1), a current I1 flows in the primary coil. The magnetic flux $\phi$ that is generated as a result flows in the core 3, which forms a closed magnetic circuit, and an induction electromotive force V2 is generated in the secondary coil (having number of turns N2=1) due to the magnetic flux $\phi$, and a current I2 flows. Because a closed magnetic circuit is formed by the core 3, there is in theory no magnetic flux leakage, so that the primary side energy V1×I1 and the secondary side energy V2×I2 become essentially equal.

Here, the energy generated in the secondary side (V2×I2) is the amount of heat generated by the fusing roller 1 as a whole. Since the number of turns in the coil varies from the center to the ends in this embodiment, the distribution of generated magnetic flux varies from the center to the ends. Consequently, the heat distribution in the fusing roller 1 is higher in the end areas where the number of turns is larger. Therefore, by adjusting the number of turns so that the amount of heat in the end areas is larger to compensate for the amount of heat escaping from the them, a uniform temperature may be maintained throughout the fusing roller 1, as shown in FIG. 3.

As described above, in this embodiment 1, simply by varying the diameter of the lead wire and wrapping it around the core, a uniform temperature distribution may be obtained along the width of the paper.

In the embodiment 1 explained above, the diameter of one lead wire was varied along its length, but it is also acceptable if multiple lead wires having different diameters, i.e., multiple coils, are used instead.

Figure 5:
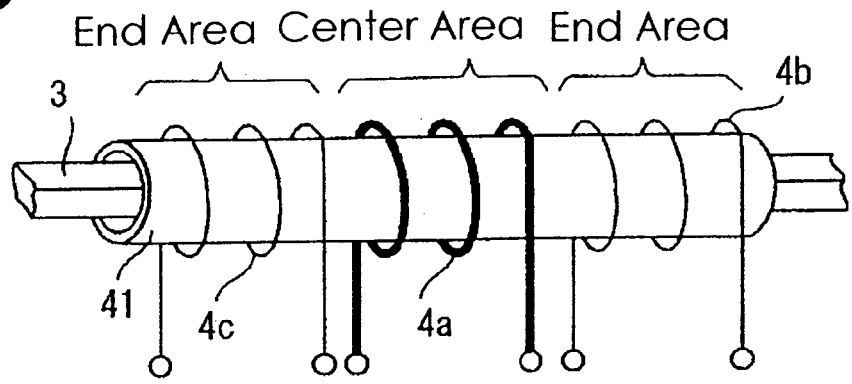
FIG. 5 is a drawing showing a modified example of the inductive coil pertaining to the embodiment 1.

FIG. 5 shows an example of a modified embodiment 1 in which three coils are used. The coil 4*a* used for the center of the core has a larger diameter than the coils 4*b* and 4*c* used for the end areas. The coil 4*a* in the center and the coils 4*b* and 4*c* in the end areas are connected in parallel. Therefore, the number of turns in the end areas is larger than in the center in which a larger lead wire is used, so that the amount of heat generated in either end increases to compensate for the heat that escapes from the end areas, where heat easily escapes. As a result, a uniform temperature may be maintained throughout the length of the fusing roller.

[Embodiment 2]

The fusing device of the embodiment 2 is a single-edge reference type fusing device that conveys the sheet using one edge of the sheet as the reference for conveyance. The basic construction of this fusing device is the same as that of the embodiment 1 explained above (FIG. 1), and its explanation will not be repeated.

In a single-edge reference type fusing device, since sheets pass along the reference side of the fusing roller 1 at all times, the heat of that side is lost to the sheets. On the other hand, the other end, which is termed the non-conveyance end, does not come into contact with sheets when the sheets are small, and therefore does not always lose heat to the sheets. Consequently, it is necessary to adjust the heat distribution of the fusing roller such that the conveyance reference end (the side from which heat is lost to the sheets) is higher than the appropriate fusing temperature. Therefore, in a conventional fusing device, the temperature of the non-conveyance end would be made higher, resulting in wasteful loss the heat of that area.

Figure 6:
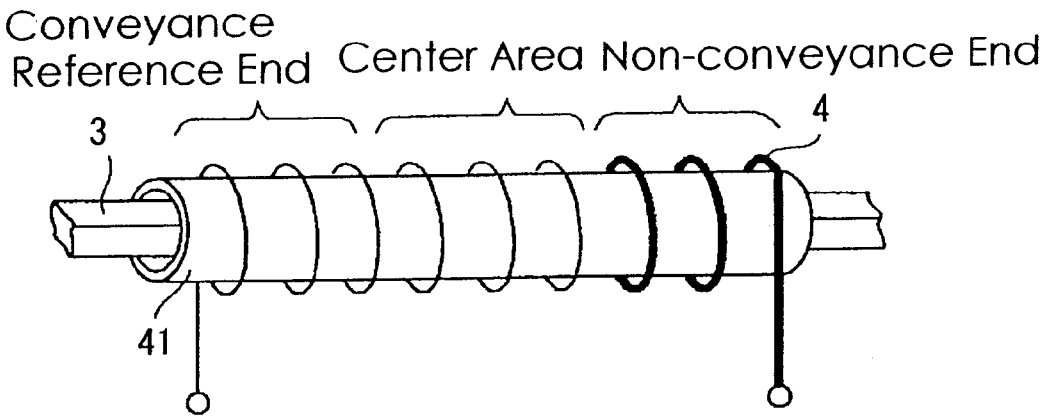
FIG. 6 is a perspective view showing the inductive coil pertaining to an embodiment 2.

FIG. 6 is a drawing showing the inductive coil pertaining to the embodiment 2.

As shown in FIG. 6, in the embodiment 2, the diameter of the wire comprising the conductive coil 4 in the non-conveyance end is larger than the diameter at the conveyance reference end and the center area. Therefore, as in the embodiment 1 explained above, the number of turns at the non-conveyance end where the diameter is larger is smaller, and therefore the amount of heat generated is reduced to that extent. On the other hand, at the conveyance reference end and center area where the diameter is smaller, the number of turns in the coil is larger, and the amount of heat generated is increased to that extent.

Figure 7:
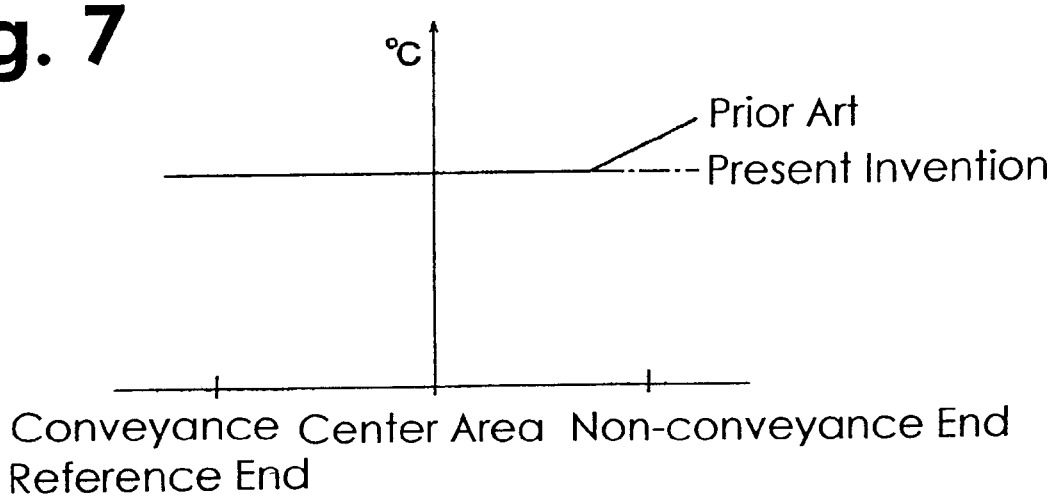
FIG. 7 is a drawing showing the temperature distribution in a single-edge reference type induction heating fusing device.

Therefore, as shown in FIG. 7, in comparison with a conventional device, the temperature in the non-conveyance end does not increase, and a uniform temperature distribution may be obtained even if the fusing device uses a single-edge reference method for sheet conveyance.

Figure 8:
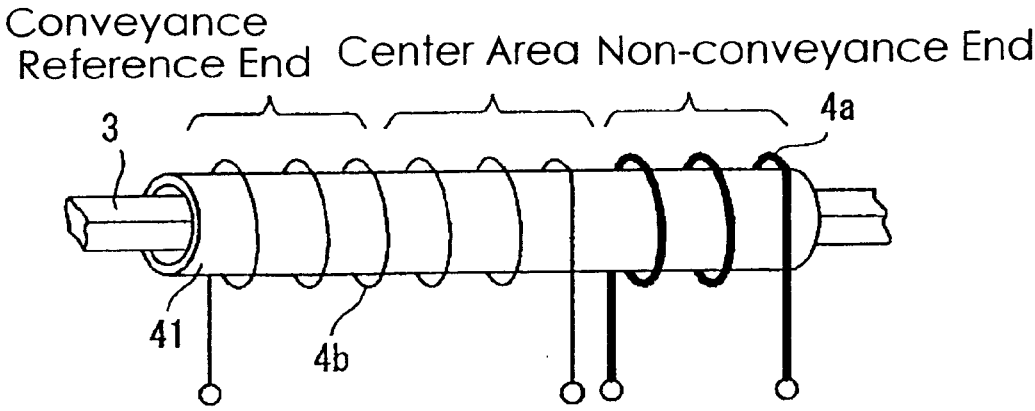
FIG. 8 is a drawing showing a modified example of the inductive coil pertaining to the embodiment 2.

FIG. 8 is a drawing showing a modified example of the inductive coil of the embodiment 2. As shown in the drawing, in the embodiment 2 as well, separate inductive coils may be used for the non-conveyance end, conveyance reference end, and center area. In this case, the diameter of the wire of the inductive coil 4*a* at the non-conveyance end is made larger than the diameter of the wire of the inductive coil 4*b* at the conveyance reference end and the center area. Consequently, as in the embodiment explained above, a uniform temperature distribution may be obtained even if the fusing device uses a single-edge reference method for sheet conveyance.

As explained above, using the present invention, because the number of turns may be changed between the center and the ends of the coil simply by changing the diameter of wire comprising the inductive coil, the temperature drop at the end areas of the fusing device may be compensated for, and the temperature may therefore be made uniform along the entire width of the sheet. Therefore, even if temperature control is performed with reference to the end areas, the center area is not excessively heated, resulting in energy conservation. In addition, the present invention may be used in a single-edge reference type fusing device, and can ensure a uniform temperature throughout the entire width of the sheet.

What is claimed is:

1. An induction heating fusing device comprising:

a core which forms a magnetic circuit;

an inductive coil which has at least one lead wire and is located around said core; and an endless conductive member which is arranged along said core, wherein a diameter of said at least one lead wire at a center of a length of said core is different from a diameter of said at least one lead wire at one end of said core.

2. An induction heating fusing device as claimed in claim 1, wherein the diameter of said at least one lead wire is larger at the center of the length of the core than at the one end of the core.

3. An induction heating fusing device as claimed in claim 2, wherein a number of turns of said at least one lead wire at the center of the length of the core is smaller than a number of turns of said at least one lead wire at the one end of the core.

4. An induction heating fusing device as claimed in claim 1, wherein the diameter of said at least one lead wire is smaller at the center of the length of the core than at the one end of the core.

5. An induction heating fusing device as claimed in claim 4, wherein a number of turns of said at least one lead wire at the center of the length of the core is larger than a number of turns of at least one lead wire at the one end of the core.

6. An induction heating fusing device comprising:

a core which forms a magnetic circuit;

a first inductive coil which has a first lead wire and is located around said core;

a second inductive coil which is located around said core and has a second lead wire of which a diameter is different from a diameter of said first lead wire and; and a conductive member which is arranged along said core.

7. An induction heating fusing device as claimed in claim 6, wherein said first coil is positioned at a center of a length of said core, and said second coil is positioned at a one end of said core.

8. An induction heating fusing device as claimed in claim 7, wherein the diameter of said first lead wire is larger than the diameter of said second lead wire.

9. An induction heating fusing device as claimed in claim 7, wherein the diameter of said first lead wire is smaller than the diameter of said second lead wire.

10. An induction heating fusing device as claimed in claim 7, wherein a number of turns of said first coil is different from a number of turns of said second coil.

11. An induction heating fusing device as claimed in claim 10, wherein the number of turns of said first coil is smaller than the number of turns of said second coil.

12. An induction heating fusing device as claimed in claim 10, wherein the number of turns of said first coil is larger than the number of turns of said second coil.

* * * * *